US011819152B1

(12) United States Patent
Turner

(10) Patent No.: US 11,819,152 B1
(45) Date of Patent: Nov. 21, 2023

(54) BEDDING USING PICTURES AS A GUIDE

(71) Applicant: Patricia Ann Turner, Bellflower, CA (US)

(72) Inventor: Patricia Ann Turner, Bellflower, CA (US)

( * ) Notice: Subject to any disclaimer, the term of this patent is extended or adjusted under 35 U.S.C. 154(b) by 0 days.

(21) Appl. No.: 18/096,787

(22) Filed: Jan. 13, 2023

(51) Int. Cl.
*A47G 9/02* (2006.01)

(52) U.S. Cl.
CPC ..... *A47G 9/02* (2013.01)

(58) Field of Classification Search
CPC . A47G 9/02; A47G 9/0238; A47G 2009/0276
See application file for complete search history.

(56) References Cited

U.S. PATENT DOCUMENTS 3,613,133 A * 10/1971 Isola et al. ..... A47G 9/02 446/72
4,442,558 A * 4/1984 Alexander ..... A47G 9/02 5/482
4,875,245 A * 10/1989 Isola ..... A47G 9/02 5/490
4,934,939 A * 6/1990 Bonneville ..... G09B 19/00 434/433
4,972,533 A * 11/1990 Brown ..... A47G 9/0207 5/413 R
5,208,926 A * 5/1993 Stackhouse ..... A47C 21/022 5/482
8,516,631 B1 * 8/2013 Conley ..... A47G 9/02 5/490
2012/0060283 A1 * 3/2012 Campasano ..... A47G 9/0238 5/495
2013/0067660 A1 * 3/2013 Sloan ..... A47G 9/02 5/413 R
2014/0259408 A1 * 9/2014 Morley ..... A47G 9/02 5/482
2020/0256011 A1 * 8/2020 Jain ..... A47G 9/0261

* cited by examiner

*Primary Examiner* — Eric J Kurilla
(74) *Attorney, Agent, or Firm* — Lowenstein Sandler LLP

(57) ABSTRACT

A bedding system to position above a mattress in a first arrangement. The bedding system has a bedspread with an upper portion, a bottom surface, and a top surface positioned opposite the bottom surface. In the first arrangement the top surface of the bedspread faces opposite the mattress. A first part of a continuous picture is formed on the bottom surface of the bedspread. In the first arrangement, the upper portion is folded to display the first part of the continuous picture. A pillow cover is configured to encase a pillow with a second part of the continuous picture formed on the pillow cover. In the first arrangement, the pillow cover is positioned adjacent to the bedspread to align the second part of the continuous picture with the first part of the continuous picture of the bedspread to assemble at least a portion of the continuous picture for display.

18 Claims, 7 Drawing Sheets

BEDDING USING PICTURES AS A GUIDE

TECHNICAL FIELD

Embodiments of the disclosure relate generally to bedding systems, and in particular bedding systems using pictures as guides.

BACKGROUND

Bedding can include coverings for a bed, such as various types of sheets and blankets.

BRIEF DESCRIPTION OF THE DRAWINGS

The disclosure will be understood more fully from the detailed description given below and from the accompanying drawings of various embodiments of the disclosure. The drawings, however, should not be taken to limit the disclosure to the specific embodiments, but are for explanation and understanding only.

DETAILED DESCRIPTION

Figure 1:
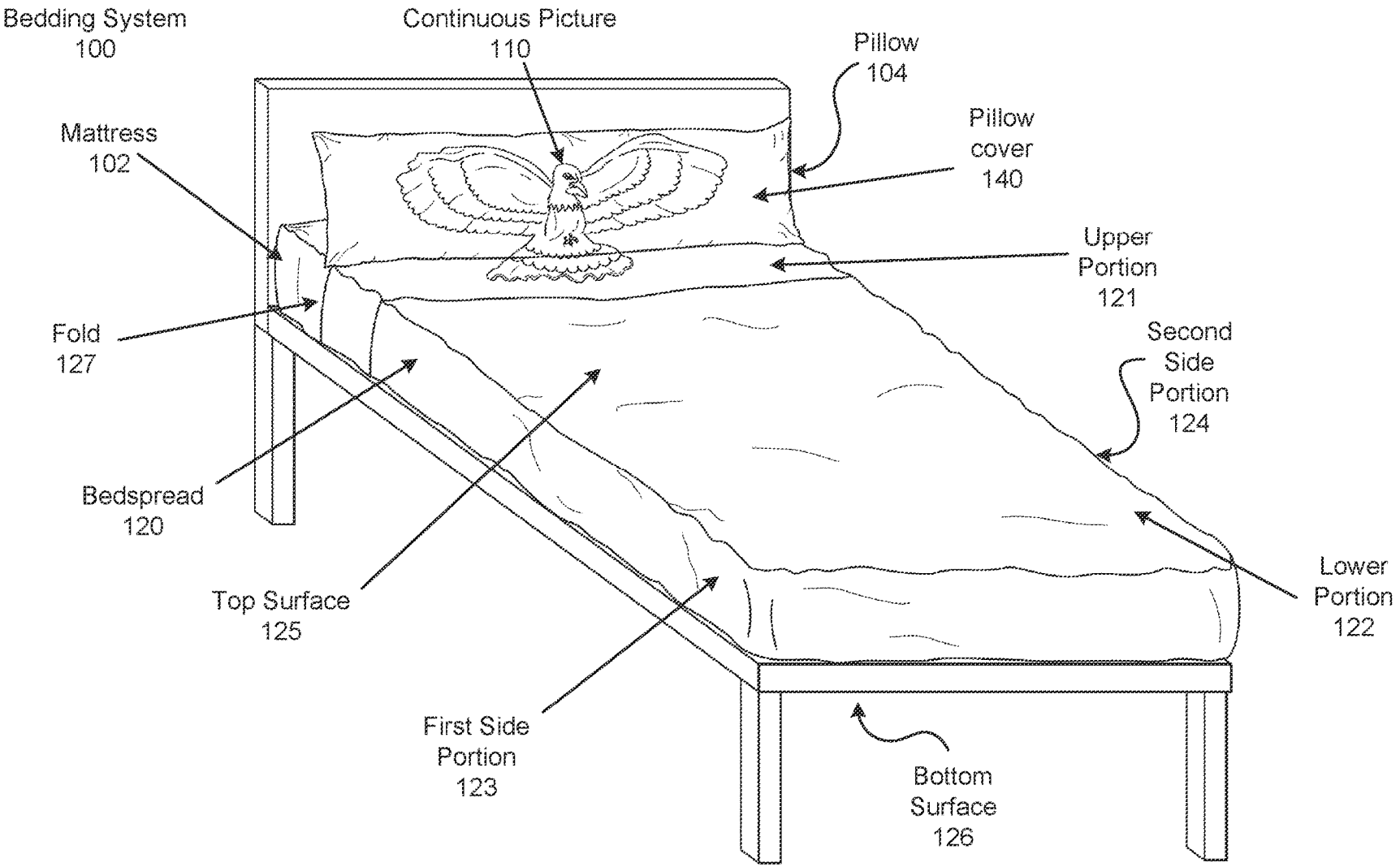
FIG. 1 illustrates an example embodiment of a bed with a bedding system, in accordance with some embodiments.

Aspects of the present disclosure are directed to a bedding system that uses pictures as guides to allow for consistent arrangement of bedding, such as pillow covers and a bedspread on a mattress.

Bedding (also referred to as "set of bedding") of a bedding system can refer to objects or elements designed to be applied or fitted to a mattress or pillow, and can include for example, objects such as fitted sheets, unfitted sheets, blankets, bedspreads, pillowcases, and pillow covers. Examples of bedding systems are described below in conjunction with FIG. 1.

Bedding has been used for centuries to improve the sleeping experience. Bedding can improve sleep hygiene, sleep comfort, body temperature regulation, and the visual appearance of a sleeping location (e.g., a bed or bedroom), among others. For example, a fitted sheet can act as an additional barrier of protection to protect the mattress from germs and dirt, as well as enable the sheet to stay in place throughout a night of tossing and turning. Blankets and unfitted sheets can improve sleep comfort and regulate body temperature by trapping body heat or helping a sleeper feel secure. A set of matched bedding can improve the appearance of a bed. However, when bedding is inadequately arranged, these improvements to the sleep experience can be compromised.

Arranging bedding into an arrangement that produces improvements to the sleeping experience, such as those discussed above, can be difficult for anyone, and in particular for young children, elderly individuals, and individuals of any age with mental or physical impairments. Arranging bedding not only can be a challenging task, but also lacks a creative or "fun" aspect that engages people, and in particular engages children in a manner that encourages consistent bed making habits.

Arranging bedding consistently such that the arranged bedding has a consistent appearance and/or arrangement can also be challenging when the number of beds to be made is high. For example, in the hotel industry a large number of beds are made every day and at a particular hotel, it may be desirable to have the bedding arrangements appear consistent across all the rooms of the hotel, and to have the consistency of the bedding arrangements easily verified.

Aspects of the present disclosure address the above and other deficiencies with a bedding system which positions above a mattress in a particular arrangement (e.g., an initial, specified, or first arrangement, etc.). The bedding system can include bedding such as a bedspread and one or more pillow covers. Two or more pieces of the bedding, such as the bedspread and one or more pillow covers, can each have a part of a continuous picture positioned in a beneficial location that help guide a user as to how the bedding is to be arranged. The bedding, when assembled in the specified arrangement (based on the picture guide) displays a continuous picture using the various parts of the picture (located on different pieces of bedding) arranged in the specified manner. The aspects of the disclosure, as described herein, help a user of the bedding system consistently arrange the bedding in a specified arrangement, which improves sleep hygiene, sleep comfort, body temperature regulation, and the visual appearance of a sleeping location. The aspects of the disclosure, as described herein, can also make the task of bedmaking more widely accessible and enjoyable, as well as help provide consistency across many bedding arrangements.

"Continuous picture" or "picture," can describe a visual representation of an object, such as a scene, landscape, image, or story. In some instances, a picture can be a visual representation of an idea or object. The continuous picture can include one or more parts that—like a jigsaw puzzle—when assembled display the picture (e.g., image). For example, a bedspread arranged on a mattress can have one part of the continuous picture, and a pillow cover arranged on a pillow can have another part of the continuous picture, such that the pillow cover can be positioned adjacent to the bedspread in a specified arrangement to assemble the continuous picture for display. However, in some embodiments, like a jigsaw puzzle, when the pillow cover is not placed adjacent to the bedspread in the specified arrangement, the continuous picture may not be properly assembled for display. It can be noted that although embodiments implementing a continuous picture are used for purposes of illustration rather than limitation. In other embodiments, different types of guides other than a picture can be implemented such as a design, color/fabric scheme, among others.

"Bedspread" can describe the outermost layer of bedding on a mattress in a bedding system. For example, a bedspread can couple to a mattress that has no bedding, as well as a mattress that has one or multiple layers or pieces of bedding (e.g., such as a fitted sheet, an unfitted sheet, a blanket, etc.).

A bedspread can include multiple portions, such as an upper portion, a lower portion, and side portions, with top and bottom surfaces of the multiple portions.

"Pillow cover" can describe the outermost layer of bedding on a pillow in a bedding system. For example, a pillow cover can couple to a pillow that has no bedding, as well as a pillow that has one or multiple layers or pieces of bedding (e.g., such as a pillowcase). A pillow cover can include multiple portions, such as a front portion (or "front side"), a back portion ("back side") and may have openings at either end or both ends (e.g., lateral sides) that are designed to receive a pillow. In some instances, the pillow cover can have an opening at the back side designed to receive a pillow. It can be noted that parts of a picture on one or more pillow covers is described for purposes of illustration, rather than limitation. In some embodiments, a part of the continuous picture can be formed on a pillowcase that may or may not be fitted in a pillow cover.

The following figure descriptions include the terms "couple" or "coupling." "Coupling," "coupled" or the like can refer to a direct physical connection or indirect physical connection between two or more objects. In some cases, "coupling," "coupled," or the like can refer to separate parts of a contiguous object (e.g., the first part of the rope is coupled to the second part of the rope).

The following figure descriptions include the term "mattress." "Mattress" can refer to the part of a bed used for sleeping on. "Mattress" can also refer to the part of a bed used for sleeping on coupled to one or more bedding elements (e.g., "mattress" may refer to a mattress coupled to a fitted sheet and a top sheet). A mattress can be filled with a resilient material such as cotton, feathers, foam, or an arrangement of coiled springs.

The following figure descriptions include the term "pillow." "Pillow" can refer to a support for the head of a reclining person. "Pillow" can also refer to a part of a bedding system positioned on a mattress and that is used to support a portion of a sleeper's body. A pillow may refer to a pillow alone or a pillow fitted within a pillowcase, unless otherwise described.

The follow figure descriptions include the term "pleats," or "pleated." "Pleats," or the like can refer to a fold, or doubling of fabric that is pressed, ironed, or creased into place. Pressed pleats can form a sharp crease, whereas unpressed pleats can form rounded curves. A pleat can be sewn into place, and a sewn-in-place pleat can be referred to as a tuck. Various types of pleats can include accordion pleats, box pleats, cartridge pleats, fluted pleats, knife pleats, and plissé pleats. Other pleat types are also considered.

It can be noted that for purposes of illustration, rather than limitation, the bedding system is described as implemented on a generic bed, which can be representative of multiple mattress and pillow sizes (e.g., a twin, full, queen, king, etc.). In most embodiments, the bedding system can be used with other bed sizes than those pictured or described.

Spatially relative terms, such as "upper," "lower," "top," "bottom," "left," "right," "above," and so forth as used herein refer to a relative position of one element with respect to another element. Unless otherwise specified, the spatially relative terms are not intended to be limiting to the absolute orientation, and are intended to encompass different orientations (e.g., rotated 90 degrees, inverted, flipped) of elements in addition to the orientation depicted in the Figures. For example, if elements in the Figures are inverted, elements described as "upper" elements can then be considered oriented as "lower" elements, without deviating from aspects of the disclosure.

FIG. 1 illustrates an example embodiment of a bed with bedding system 100, in accordance with some embodiments. Bedding system 100 includes continuous picture 110, bedspread 120, and one or more pillow covers 140. Although not illustrated, bedding system can include other types of bedding including a fitted sheet, a top sheet, a bed skirt, one more blankets, among other types of bedding.

Continuous picture 110 is displayed by assembling one or more parts of continuous picture 110 in a particular arrangement (e.g., a "specified arrangement"). In some embodiments, a part of continuous picture 110 can be formed on bedspread 120 and another part of continuous picture 110 can be formed on pillow cover 140 (e.g., one or more pillow covers). In some embodiments, parts of continuous picture 110 can be formed on particular portions of bedspread 120 and/or pillow cover 140 (e.g., on an upper portion of bedspread 120, a front side of pillow cover 140, etc.). In some embodiments, particular parts of continuous picture 110 can be formed on either bedspread 120 or pillow cover 140. For example, in some embodiments, a lower part of continuous picture 110 can be formed on bedspread 120, and an upper part of continuous picture 110 can be formed on pillow cover 140. It should be noted that in other embodiments, additional parts of the continuous picture can be formed at different areas of the bedspread 120 or pillow cover 140, or be formed on additional pieces of bedding, such as an additional pillow cover. It can be noted that a guide, such as part of a continuous picture, is described as formed on one or more pillowcases and a bedspread for purposes of illustration, rather than limitation. In other embodiments, other parts of the bedding can include a guide, such as a picture, in accordance with aspects of the disclosure. In some embodiments, assembled continuous picture 110 can depict an image (e.g., such as a landscape, scenery, a story, or scenario, etc.). Further details regarding the continuous picture 110 are described below with respect to FIG. 2.

Bedspread 120 is positioned above mattress 102. In some embodiments, bedspread 120 can have multiple portions such as upper portion 121, lower portion 122, first side portion 123 and second side portion 124, with top surface 125 of the multiple portions and bottom surface 126 (e.g., not readily visible) of the multiple portions. In some embodiments, upper portion 121 can be positioned at one end of mattress 102 (e.g., the "top end" of mattress 102, "upper end," "mattress head," etc.). In some embodiments, lower portion 122 can be positioned to extend from near the top end of mattress 102 to an opposite end of mattress 102 (e.g., the "bottom end" of mattress 102, "lower end," "mattress foot," etc.). In some embodiments, first side portion 123 can be positioned approximately orthogonal (e.g., ±10 degrees from orthogonal) to upper side and/or lower side, along one side of mattress 102 (e.g., when viewed from the foot of the bed, a left sidewall of mattress 102) which extends from the top end of mattress 102 to the bottom end of mattress 102. In some embodiments, second side portion 124 can be positioned approximately orthogonal to upper portion 121 and lower portion 122 along an opposite side of mattress 102 (e.g., when viewed from the foot of the bed a right sidewall of mattress 102) which extends from upper end of mattress 102 to lower end of mattress 102. In some embodiments, bedspread 120 can be arranged as an outer layer above mattress 102 (e.g., outermost layer of bedding), with other bedding systems (e.g., sheets, blankets, etc.) positioned between bedspread 120 and mattress 102. In some embodiments, at least part, and in many cases the majority of the outer surface of the bedspread 120 can be designed to be displayed when the bedding system is in the specified arrangement.

In some embodiments, first side portion 123 and second side portion 124 can be sewn to one or more of the upper portion 121 or lower portion 122 of the bedspread 120, and may be formed of a different material and/or pattern (e.g., without pleats) to help reduce manufacturing complexity and improve the manufacturability of bedspread 120. For example, in some embodiments, first side portion 123 and second side portion 124 that are sewn to the bedspread 120 can reduce the surface area size of top surface 125 of lower portion 122, thus reducing manufacturing complexities that can be associated with producing some embodiments of lower portion 122 (e.g., producing pleats). Additionally, in some embodiments, implementing a first side portion 123 and second side portion 124 that is sewn to bedspread 120 can reduce the complexity of adding fitted corners, and/or fitted "pockets" to bedspread 120, thus reducing manufacturing complexities that can be associated with adding fitted corners or "pockets" to some embodiments of lower portion 122. In other embodiments, first side portion 123 and second side portion 124 can a contiguous part of one or more of the upper portion 121 or lower portion 122 of the bedspread 120 (e.g., not sewn together and/or of the same fabric or pattern).

In some embodiments, upper portion 121 can be coupled to lower portion 122. In some embodiments, upper portion 121 and lower portion 122 can be contiguous. In other embodiments, upper portion 121 and lower portion 122 can be separate pieces of fabric that are sewn together. The separate pieces of fabric may have the same or different pattern (e.g., non-pleated upper portion 121 and pleated lower portion 122). In some embodiments, implementing an upper portion 121 and a lower portion 122 as separate pieces of fabric can help reduce manufacturing complexities associated with the bedspread 120. For instance, a part of continuous picture may be formed on the upper portion 121 and later sewn to a pleated lower portion 122, which in some cases may help manufacturability.

In some embodiments, first side portion 123 can be coupled (e.g., they can be a contiguous piece or separate pieces that are sewn together) to a part of one side of upper portion 121 (e.g., when viewed from the foot of the bed, a left side of upper portion 121) and second side portion 124 can be coupled (e.g., they can be a contiguous piece or separate pieces that are sewn together) to a part of another side of upper portion 121 (e.g., when viewed from the foot of the bed, a right side of upper portion 121). In some embodiments, first side portion 123 and second side portion 124 can couple to part of the same side of upper portion 121 (e.g., when viewed from the foot of the bed, a bottom side of upper portion 121). In some embodiments, first side portion 123 can be coupled (e.g., they can be a contiguous piece or separate pieces that are sewn together) to part of one side of lower portion 122 (e.g., the left side of lower portion 122 described above) and second side portion 124 can be coupled (e.g., they can be a contiguous piece or separate pieces that are sewn together) to part of another side of lower portion 122 (e.g., the right side of lower portion 122 described above). In some embodiments, upper portion 121 can extend past coupled lower portion 122, such that the combination of the portions resemble a "T-shape." In some embodiments, first side portion 123 and second side portion 124 can couple to upper portion 121 and lower portion 122 such that each side portion respectively "fills-in" the "missing portions" of the "T-shape" to form a rectangular shape.

In some embodiments, a part of continuous picture 110 can be formed on upper portion 121. In some embodiments, a part of continuous picture 110 can be formed on bottom surface 126 of bedspread 120. In some embodiments, a part of continuous picture 110 can be formed on bottom surface 126 of upper portion 121. For example, by forming the part of the continuous picture 110 on the bottom surface of the upper portion 121, the part of the continuous picture 110 can be used as guide to direct the user where the bedspread 120 (e.g., the upper portion 121) is to be folded back to display the respective part of the continuous picture 110 outwardly. In some embodiments, the size of upper portion 121 can be associated with the size of the part of continuous picture 110 formed on upper portion 121.

In some embodiments, the size of upper portion 121 can indicate a fold location, such as fold 127. Fold 127 can indicate where to fold down bedspread 120 to display the bottom surface 126 of upper portion 121. When bedspread is folded at fold 127, it can be in a specified, or folded arrangement. When bedspread is not folded at fold 127 (e.g., bedspread is unfolded), it can be in an initial, or unfolded arrangement. Further details regarding bedspread arrangements are described below with respect to FIGS. 4A-4C.

In some embodiments, lower portion 122 of bedspread 120 can have one or more layers (e.g., a top layer, bottom layer, etc.). A top layer of the lower portion can include two or more sections (e.g., a first layer and a second layer) coupled together with multiple stitches to help manufacturability. For instance, some pleats are manufactured in widths shorter than a width of lower portion 122 of bedspread 120, and using two or more sections can enable, or at least help, the manufacturability of the lower portion 122. One or more bottom layers (e.g., third layer) can be coupled to the first layer with multiple stiches to secure the first fabric layer to the third layer. In some embodiments, the third layer can help secure the pleats and/or add an additional layer of material to provide additional insulation (e.g., warmth) to the bedspread 120. In some embodiments, the first layer can have multiple pleats. In some embodiments, the second layer can have multiple pleats. In some embodiments, the third layer can be unpleated. Further details regarding bedspread pleats are described below with respect to FIGS. 5A-5B.

In some embodiments, lower portion 122 of bedspread 120 can include a fitted end or portion. First side portion 123 and second side portion 124 can include respective fitted ends or portions. Further details regarding bedspread fitted portions are described below with respect to FIGS. 6A-6B.

Pillow cover 140 at least partially encases pillow 104. In some embodiments, pillow cover 140 can encase more than one pillow. Bedding system 100 can include one or more one pillow covers, such as pillow cover 140. Pillow 104 is positioned adjacent to the top end of mattress 102. Pillow cover 140 can be arranged as an outer layer around pillow 104 (e.g., outermost layer), with additional bedding (e.g., pillowcases) positioned between pillow cover 140 and pillow 104. The outer surface of pillow cover 140 can be designed to be displayed. In some embodiments, pillow cover 140 can be a pillowcase. Pillow cover 140 can have a front side and a back side. The front side of pillow cover 140 is designed to face outwards (e.g., towards a viewer) and the back side of pillow cover 140 is designed to face away from a viewer. In some embodiments, a part of continuous picture 110 can be formed on pillow cover 140. In some embodiments, a part of continuous picture 110 can be formed on a front side of pillow cover 140. In some embodiments, a portion of pillow cover 140 can be pleated with multiple pleats. Further details regarding the pillow cover such as pillow cover 140 are described below with respect to FIG. 3.

Figure 2:
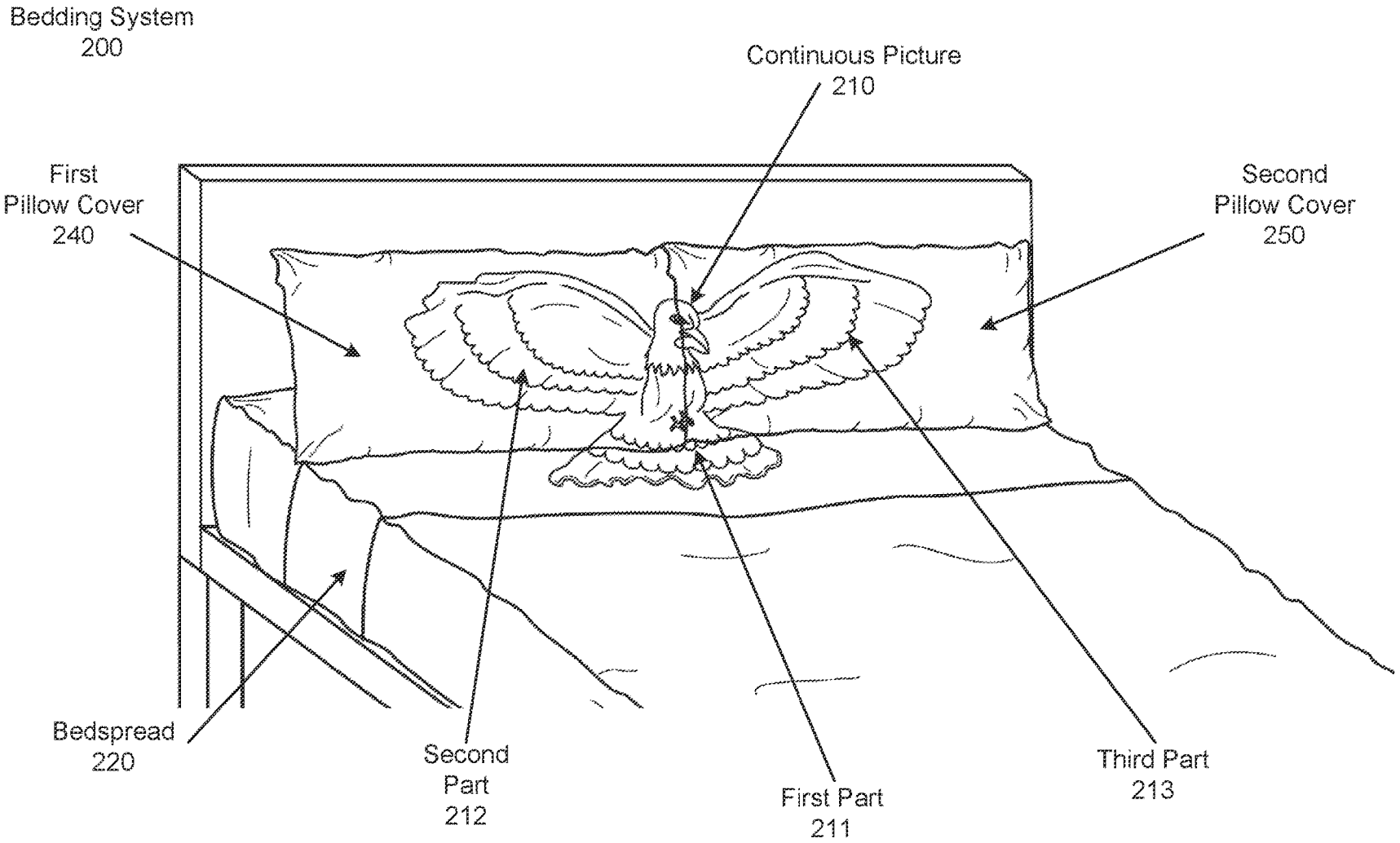
FIG. 2 illustrate an example embodiment of a bed with the bedding system, in accordance with some embodiments.

FIG. 2 illustrates an example embodiment of a bed with bedding system 200, in accordance with some embodiments. Bedding system 200 includes continuous picture 210, bedspread 220, first pillow cover 240, and second pillow cover 250. In some embodiments, continuous picture 210 has first part 211, second part 212, and third part 213. In some embodiments, continuous picture 210 can include more than three parts (e.g., more than first part 211, second part 212, and third part 213). First part 211 of continuous picture 210 can be formed on bedspread 220. Second part 212 of continuous picture 210 can be formed on first pillow cover 240 and can indicate a first front side of first pillow cover 240. Third part 213 of continuous picture 210 can be formed on second pillow cover 250 and can indicate a second front side of second pillow cover 250.

In some embodiments, parts of continuous picture 210 (e.g., first part 211, second part 212, and third part 213) can provide a visual indication of where the corresponding bedding should be arranged. For example, a continuous picture of a beach may have the sky or background split into two portions (corresponding to second part 212 and third part 213 respectively), with the sand and water split onto another portion (corresponding to first part 211). The parts of the continuous picture can inform a user of the intended position (e.g., rotation) of the pillow covers (such as first pillow cover 240 and second pillow cover 250) with respect to the mattress or bedspread 220. For instance, a user can be directed to place the sky-part of continuous picture 210 above the ground-part of continuous picture 210. In another example, the portion of continuous picture 210 on the bedspread (e.g., first part 211) can indicate to a user which end of the bed corresponds to the head of the bed. This can help a user arrange the bedspread with the right orientation, as some beds (e.g., more square-shaped beds such as king-size mattress beds) can have bedding systems that are easily misarranged by a user by inadvertently rotating the bedspread either clockwise or counterclockwise 90 degrees (e.g., so that the head of the bedspread is at the side of the mattress) or by inadvertently rotating the bedspread 180 degrees (e.g., so that the head of the bedspread is at the foot of the mattress).

In some embodiments, the first pillow cover 240 may be configured for a particular side of the bed (e.g., first side), and second pillow cover 250 may be configured for another side of the bed (e.g., second side) that is opposite the first side. The specified arrangement of first part 211 of continuous picture 210 of first pillow cover 240 and second part 212 of continuous picture 210 of second pillow cover 250 can guide a user to arrange first pillow cover 240 and second pillow cover 250 in the specified arrangement such that first pillow cover 240 and second pillow cover 250 are arranged at the appropriate side of the bed.

In some embodiments, assembled continuous picture 210 can depict a scene (e.g., such as a landscape, scenery, etc.). Continuous picture 210 can depict a story or scenario (e.g., the events of a book, or history, etc.). In some embodiments, continuous picture 210 can have a texture. In some embodiments, continuous picture 210 can be formed on bedspread 220, first pillow cover 240, and/or second pillow cover 250 respectively by a machine or person. Continuous picture 210 can be formed with the aid of a machine. Continuous picture 210 can be formed with a paint, or a paint-like material (e.g., such as fabric paint, or dye). Continuous picture 210 can be formed with stitching and/or other fabrics (e.g., such as with embroidery, quilting, etc.). In some embodiments, other methods or mediums may be used to form the continuous picture 210. In some embodiments, first part 211 may be formed using first material (e.g., paint, thread, dye, fabric, etc.) and second part 212 and third part 213 may be formed using a second material (e.g., paint, thread, dye, fabric, etc.). In some embodiments, second part 212 and third part 213 can be formed using different methods of mediums. Third part 213 can be a mirror-image of second part 212. In some embodiments, third part 213 can be a duplicate of second part 212. First part 211, second part 212, and third part 213 of the continuous picture 210 can cover different surface area sizes (e.g., first part 211 can be a larger portion of continuous picture 210 than second part 212 or third part 213).

In some embodiments, continuous picture 210 can be displayed by assembling two or more parts of continuous picture 210 by arranging two or more pieces of bedding into a specified arrangement. For example, in some embodiments, bedspread 220, first pillow cover 240, and second pillow cover 250 can be arranged in an arrangement to display various parts (e.g., first part 211, second part 212, and third part 213) of a coherent image, such as continuous picture 210. In some embodiments, if the parts of the continuous picture 210 were not arranged in the specified arrangement, a non-coherent or partial picture would be displayed. In some embodiments, continuous picture 210 is displayed by the assembled combination of the bottom surface of upper portion of bedspread 220 (e.g., folded outwardly), the first front side of first pillow cover 240, and the second front side of second pillow cover 250. In some embodiments, assembling continuous picture 210 can include more than three pieces of bedding (e.g., more than bedspread 220, first pillow cover 240, and second pillow cover 250). In some embodiments, first part 211 of continuous picture 210 on bedspread 220 can be the lower part of a landscape. In certain embodiments, continuous picture 210 can be a bird, such as an eagle.

In some embodiments, the part of continuous picture 210 on bedspread 220 can depict a top-down or "terrain-style" view of part of continuous picture 210. In some embodiments, the part of continuous picture 210 on first pillow cover 240 can depict a front-first, or "backdrop-style" view of part of continuous picture 210.

In some embodiments, first part 211 of continuous picture 210 can indicate an arrangement of second part 212, such that second part 212 of continuous picture 210 can align with first part 211 of continuous picture 210. For example, in some embodiments, first part 211 formed on bedspread 220 can indicate an arrangement of second part 212 formed on first pillow cover 240 such that second part 212 aligns with first part 211 when first pillow cover 240 is arranged adjacent to bedspread 220 in a specified arrangement. In some embodiments, second part 212 of continuous picture 210 can indicate a rotational position of first pillow cover 240 with respect to first part 211 of continuous picture 210 (e.g., first pillow cover 240 can be arranged to display the second part 212 to a viewer, as opposed to concealing the second part 212, such as by facing the second part 212 toward the mattress).

In some embodiments, assembled continuous picture 210 can visually indicate to a bed-maker (e.g., a child, employee, etc.) that bedding system 200 has been arranged correctly or incorrectly. For example, in the illustrative example shown in FIG. 2, the bird's tail in first part 211 (on bedspread 220) is aligned with the left wing and half of the bird's body in second part 212 (on first pillow cover 240) and with the right wing and half of the bird's body in third part 213 (on second pillow cover 250). Thus, when all aligned, the bird is fully visible, and a user can know the bedding has been properly arranged. In some embodiments, assembled continuous picture 210 can quickly indicate to another observer (e.g., a parent, caregiver, employer, etc.) that the bed has been properly arranged. For example, with reference to the illustrative example of FIG. 2, another observer can verify that bedding system 200 is properly arranged when the bird is arranged as shown.

Figure 3:
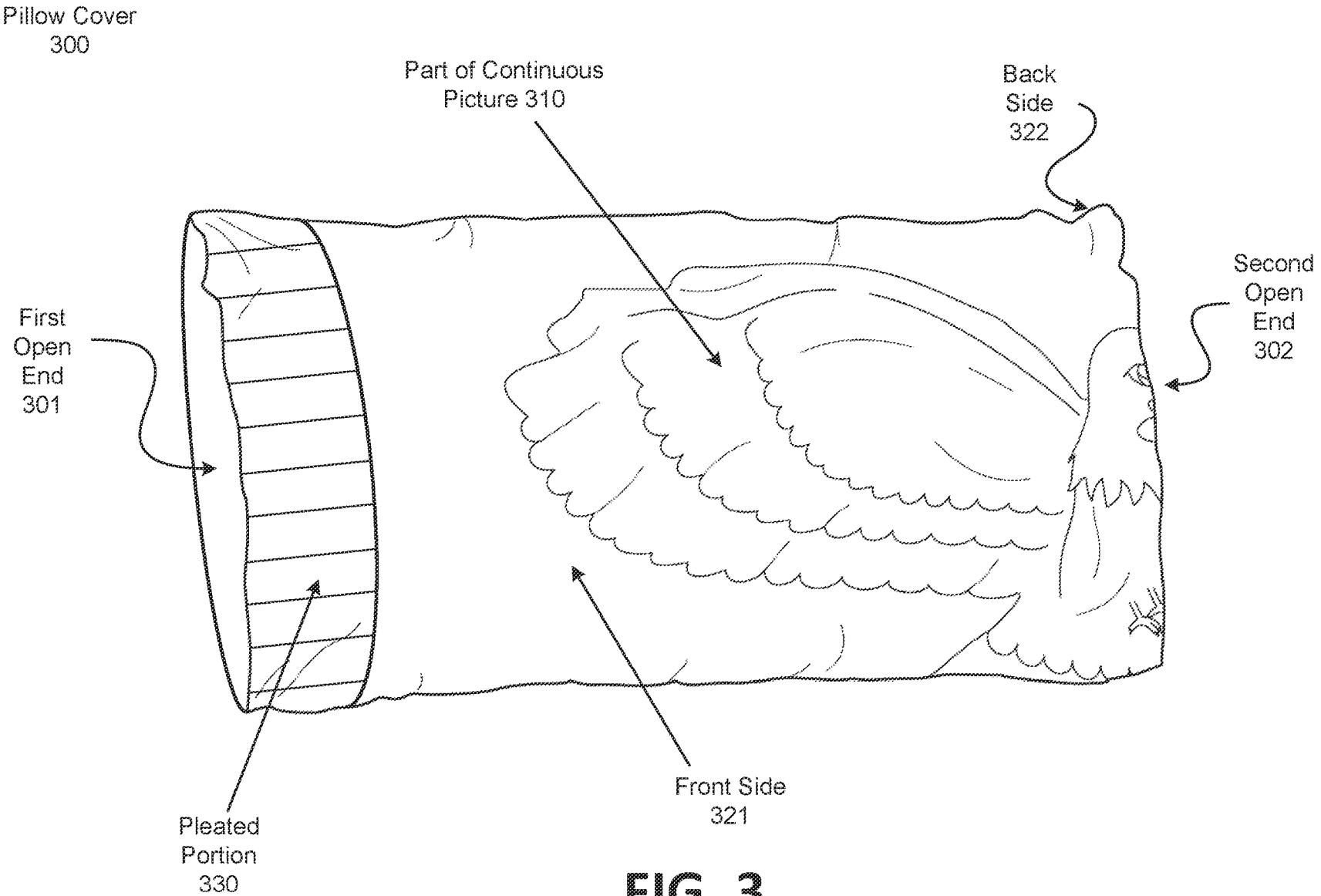
FIG. 3 illustrates an example embodiment of a pillow cover of the bedding system, in accordance with some embodiments.

FIG. 3 illustrates an example embodiment of pillow cover 300 of a bedding system, in accordance with some embodiments. Pillow cover 300 includes part of continuous picture 310, front side 321, and back side 322. In some embodiments, part of continuous picture 310 can be formed on front side 321 of pillow cover 300. In some embodiments, pillow cover 300 can include a side portion (not pictured). In some embodiments, the side portion can couple to a respective set of uncoupled edges of front side 321 and back side 322. In some embodiments, front side 321 and back side 322 can be a single piece of fabric or material.

In some embodiments, front side 321 can include first pleated portion 330. In some embodiments, first pleated portion 330 can include multiple pleats. In some embodiments, back side 322 of pillow cover 300 can include a second pleated portion (not pictured). In some embodiments, first pleated portion 330 can be coupled (either a contiguous piece of fabric or sewn together) with the second pleated portion of back side 322. In some embodiments, front side 321 of pillow cover 300 can include a third pleated portion (not pictured). In some embodiments, back side 322 of pillow cover 300 can include a fourth pleated portion (not pictured).

In some embodiments, one or more edges of front side 321 can be coupled to one or more edges of back side 322. In some embodiments, front side 321 can be couple to back side 322 with one or more seams (not pictured). In some embodiments, the one or more seams can be stitched with multiple stitches. In some embodiments, one or more edges of front side 321 are uncoupled from one or more corresponding edges of back side 322. In some embodiments, one set of uncoupled edges (e.g., one edge of front side 321, and one edge of back side 322) can be a first open end 301. In some embodiments, another set of uncoupled edges can be a second open end 302. In some embodiments, first open end 301 and second open end 302 face opposite directions (e.g., when pillow cover 300 is laying on a mattress such as mattress 102 as described with respect to FIG. 1, first open end 301 can face towards a left side of the mattress, and second open end 302 can face towards a right side of the mattress). It can be noted that in some embodiments, having two open ends may help some users (e.g., children) with the task of covering pillows with a pillow cover 300, according to some embodiments. In some embodiments, first pleated portion 330 can be adjacent or coupled to first open end 301. In some embodiments, first open end 301 can be associated with the size of a pillow (e.g., such as pillow 104 as described with respect to FIG. 1).

In some embodiments, pillow cover 300 can be configured to more easily receive a pillow than a pillowcase with one opening. For example, in some embodiments, first open end 301 and second open end 302 of pillow cover 300 can be configured such that young child, the elderly, or person with physical or mental disabilities can more easily arrange pillow cover 300 around a pillow than a pillow cover with one opening. In some embodiments, first open end 301 and second open end 302 can assist a user to learn how to consistently arrange pillow cover 300 around a pillow.

In some embodiments, part of continuous picture 310 can be one of two or more parts of an unassembled continuous picture (e.g., such as continuous picture 110 as described with respect to FIG. 1 before it is assembled). In some embodiments, pillow cover 300 can be configured to have a complimentary second pillow cover (e.g., such as second pillow cover 250 as described with respect to FIG. 2). In such embodiments, first pleated portion 330 can be positioned on an end of pillow cover 300 opposite another end of pillow cover 300 that is configured to sit adjacent to the complimentary second pillow cover.

Figures 4A, 4B, 4C:
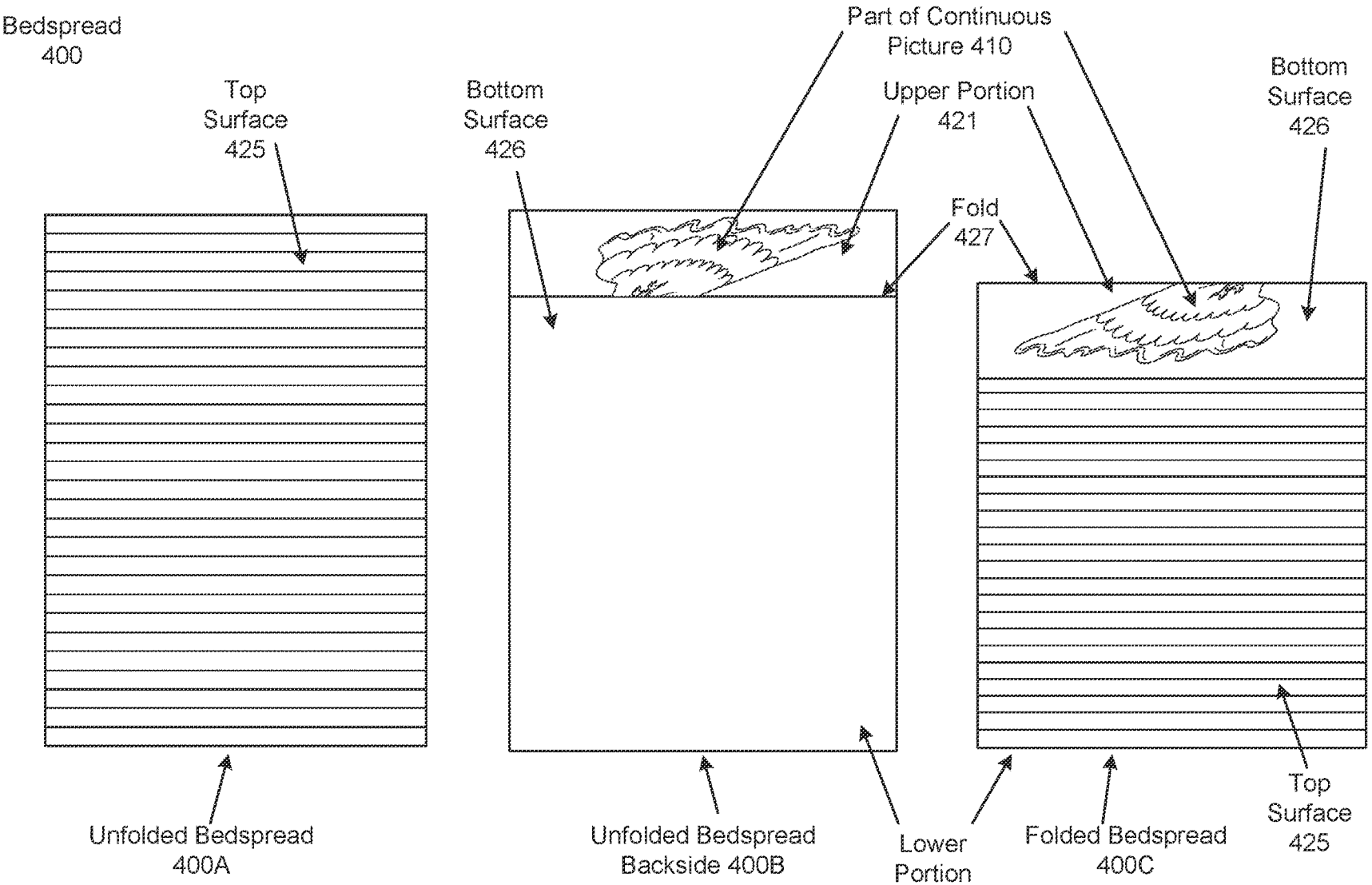
FIGS. 4A, 4B, and 4C illustrate an example embodiment of a bedspread of the bedding system, in accordance with some embodiments.

FIGS. 4A, 4B, and 4C illustrate an example embodiment of bedspread 400 of the bedding system, in accordance with some embodiments. FIG. 4A illustrates a top down view of a top surface of unfolded bedspread 400A. FIG. 4B illustrates a top down view of a bottom surface of unfolded bedspread backside 400B. FIG. 4C illustrates a top down view of a top surface of folded bedspread 400C. Unfolded bedspread 400A, unfolded bedspread backside 400B, and folded bedspread 400C (generally referred to as "bedspread 400" herein) includes part of continuous picture 410, upper portion 421, lower portion 422, top surface 425, bottom surface 426, and fold 427. It can be noted that unfolded bedspread 400A, unfolded bedspread backside 400B, and folded bedspread 400C represent the same bedspread 400 in different positions, unless otherwise described. In some embodiments, bedspread 400 can include a first side portion and a second side portion (e.g., such as first side portion 123 and second side portion 124 as described with respect to FIG. 1) coupled to upper portion 421.

Unfolded bedspread 400A can be a bedspread such as bedspread 120 as described with respect to FIG. 1 in an initial arrangement. In some embodiments, top surface 425 can include a pleated portion.

Unfolded bedspread backside 400B can the opposite side of unfolded bedspread 400A. Part of continuous picture 410 can be formed on upper portion 421. In some embodiments, part of continuous picture 410 can be formed on backside of unfolded bedspread backside 400B. The orientation of part of continuous picture 410 can be opposite the orientation of bottom surface 426 of unfolded bedspread backside 400B. For example, when viewing bottom surface 426 of unfolded bedspread backside 400B, part of continuous picture 410 can appear "upside down." Unfolded bedspread backside 400B might not have or display pleats. In some embodiments, the pleated layer can be coupled (e.g., with multiple stiches) to an unpleated layer to cover the pleats on the backside of bedspread 400, such is shown in unfolded bedspread backside 400B. As noted above, the additional layer or material can secure the pleats and/or add an additional layer of insulation to the bedspread 400.

In some embodiments, folded bedspread 400C can be a bedspread such as bedspread 120 as described with respect to FIG. 1 (e.g., an arrangement of unfolded bedspread 400A) in a specified arrangement (e.g., a "second" arrangement). In some embodiments, the location or depiction on the part of continuous picture 410 on upper portion 421 of bottom surface 426 of bedspread can identify the location of fold 427 (e.g., the size or other visual aspects of part of continuous picture 410). Fold 427 can be the location along which upper portion 421 is configured to fold down against lower portion 422. In some embodiments, folding the upper portion 421 down against lower portion 422 can transition unfolded bedspread 400A from an unfolded position to a folded position (e.g., folded bedspread 400C). In some embodiments, folding the upper portion 421 down can display part of continuous picture 410. In some embodiments, folded bedspread 400C can display part of continuous picture 410.

Figure 5A:
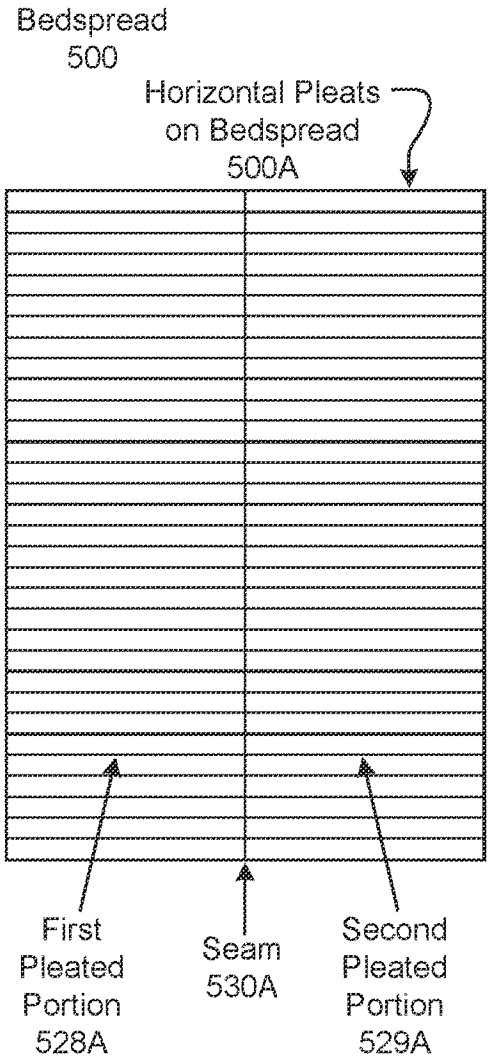
FIGS. 5A, 5B, and 5C illustrate an example embodiment of a bedspread of the bedding system, in accordance with some embodiments.
Figure 5B:
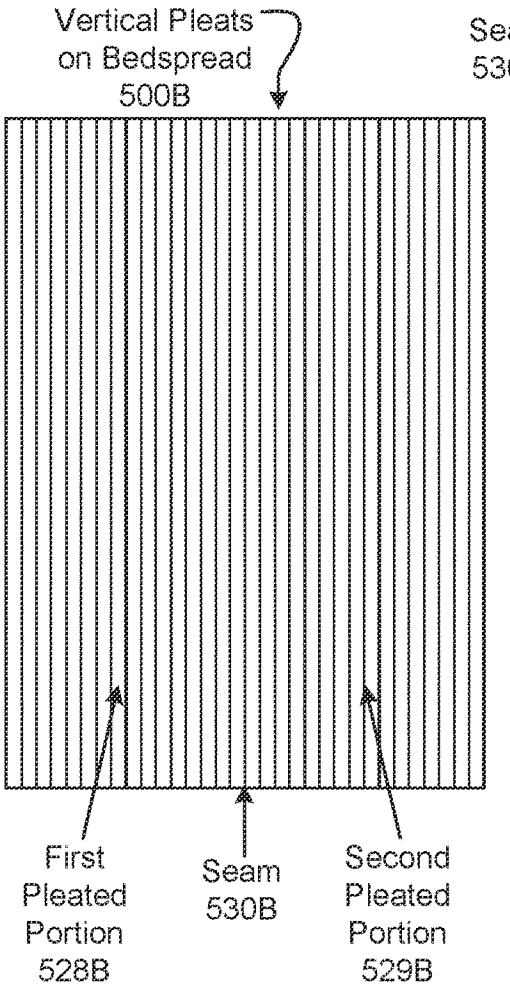
Figure 5C:
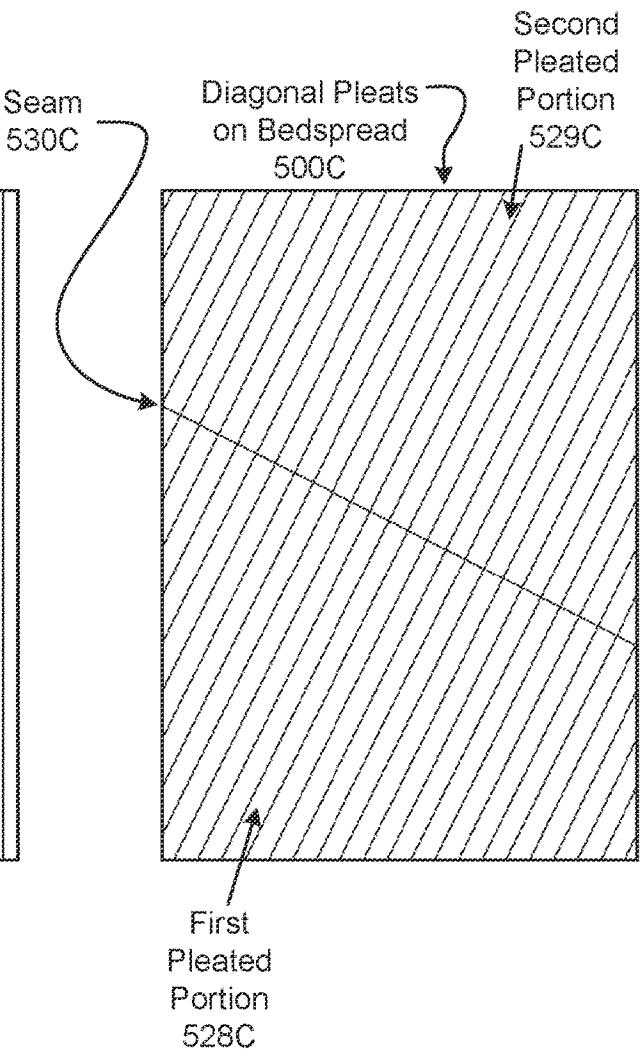

FIGS. 5A, 5B, and 5C illustrate an example embodiment of bedspread 500 of the bedding system, in accordance with some embodiments. FIG. 5A illustrates a top down view of bedspread 500A having multiple horizontal pleats. FIG. 5B illustrates a top down view of bedspread 500B having multiple vertical pleats. FIG. 5C illustrates a top down view of bedspread 500C having multiple diagonal pleats. In some embodiments, bedspread 500 can be a bedspread similar to bedspread 120 as described with respect to FIG. 1. Bedspread 500A, bedspread 500B, and bedspread 500C are generally referred to as bedspread 500.

Bedspread 500 includes first pleated portion 528, second pleated portion 529, and seam 530. In some embodiments, first pleated portion 528 can be coupled to second pleated portion 529 by seam 530. Pleats of first pleated portion 528 and second pleated portion 529 can add layered fabric to bedspread 500. First pleated portion 528 and second pleated portion 529 can couple together as a top layer of bedspread 500. In some embodiments, first pleated portion 528 can be a first layer, and second pleated portion 529 can be a second layer. The top layer can be coupled to a bottom layer. In some embodiments, the bottom layer can be a third layer. Multiple stitches can secure the top layer to the bottom layer. First horizontal pleated portion 528A, first vertical pleated portion 528B, and first diagonal pleated portion 528C are generally referred to as first pleated portion 528. Second horizontal pleated portion 529A, second vertical pleated portion 529B, and second diagonal pleated portion 529C are generally referred to as second pleated portion 529.

As noted above, a "pleat" can refer to a fold, or doubling of fabric that is pressed, ironed, or creased into place. Pressed pleats can form a sharp crease, whereas unpressed pleats can form rounded curves. A pleat can be sewn into place, and a sewn-in-place pleat can be referred to as a tuck. Various types of pleats can include accordion pleats, box pleats, cartridge pleats, fluted pleats, knife pleats, and plissé pleats. In some embodiments, a pleat can refer to gathered or layer rows or pieces of fabric, from related sewing techniques such as shining (e.g., pleats in bedspread 500 can be gathered and shined). In some embodiments, other pleat types are also considered. It can also be noted that pleats can also provide additional insulation by increasing the effective thickness of the bedspread 500.

In some embodiments, a top layer of bedspread 500 can include the multiple pleats. In some embodiments, the multiple pleats can be arranged directly adjacent to one another. In some embodiments, an unpleated bottom layer of bedspread 120 is coupled to a pleated top layer of bedspread 120. The top layer of bedspread 120 can be two or more pieces of fabric (e.g., first pleated portion 528, and second pleated portion 529) for ease of manufacturing the top layer. For instance, some manufacturing machines used to pleat material pleat material of a fixed width, which may be narrower that than the width of the bedspread. By using two or more pieces of fabric to form the top layer of the bedspread 500, the manufacturing machines can be used without retooling the machines. The two or more pieces of fabric forming the top layer of bedspread 500 can be coupled together by stitching them together along the center of bedspread 500 with the pleats of each piece of fabric all aligned along a seam (e.g., seam 530), such that the two pleated pieces appear to form a single pleat. In some embodiments, three or more pleated portions can be coupled (seamed) together.

Pleated portions of bedspread 500 can improve a sleeper's comfort. Since pleats are created by folding and layering fabric, a fabric layer of pleats can add much more fabric to the bedspread than a non-pleated fabric layer might add. The added pleated fabric layers can increase the thickness of bedspread 500 and improve the thermal insulation qualities of the bedspread 500. The thicker bedspread 500 can increase the weight of bedspread 500. For example, the thicker bedspread 500 can improve the thermal insulation of bedspread 500 to better trap a user's body heat (e.g., help keep a user warm). The increased weight and/or warmth of bedspread can improve the user's nighttime comfort.

In some embodiments, horizontal pleats on bedspread 500A can include a first horizontal pleated portion 528A and second horizontal pleated portion 529A, coupled by seam 530A. In some embodiments, first horizontal pleated portion 528A and second horizontal pleated portion 529A can each have the same number of pleats. In some embodiments, seam 530A can align the pleats of first horizontal pleated portion 528A with the pleats of second horizontal pleated portion 529A such that the respective ones of the individual pleats of each pleated portion are aligned to appear as the "same pleat" across bedspread 500A.

In some embodiments, vertical pleated on bedspread 500B can include a first vertical pleated portion 528B and second vertical pleated portion 529B, coupled by seam 530B. In some embodiments, first vertical pleated portion 528B and second vertical pleated portion 529B can each have the same number of pleats. In some embodiments, seam 530B can align the pleats of first vertical pleated portion 528B with the pleats of second vertical pleated portion 529B such that the pleats have a uniform size across bedspread 500A. In some embodiments, the pleats of first vertical pleated portion 528B or the pleats of second vertical pleated portion 529B cover seam 530B.

In some embodiments, diagonal pleats on bedspread 500C can include a first diagonal pleated portion 528C and second diagonal pleated portion 529C, coupled by seam 530C. In some embodiments, first diagonal pleated portion 528C and second diagonal pleated portion 529C can each have the same number of pleats. In some embodiments, seam 530C can align the pleats of first diagonal pleated portion 528C with the pleats of second diagonal pleated portion 529C such that respective ones of the individual pleats of each pleated portion are aligned to appear as the "same pleat" across bedspread 500C.

In some embodiments, bedspread 500 can combine two or more pleated portion types. For example, in some embodiments, bedspread 500 can match first horizontal pleated portion 528A with second vertical pleated portion 529B or with second diagonal pleated portion 529C, first vertical pleated portion 528B with second horizontal pleated portion 529A or with second diagonal pleated portion 529C, or first diagonal pleated portion 528C with second horizontal pleated portion 529A or with second vertical pleated portion 529B. In some embodiments, pleated portions may have pleat orientations other than the horizontal, vertical, or diagonal orientations illustrated in FIGS. 5A-5C.

Figures 6A, 6B:
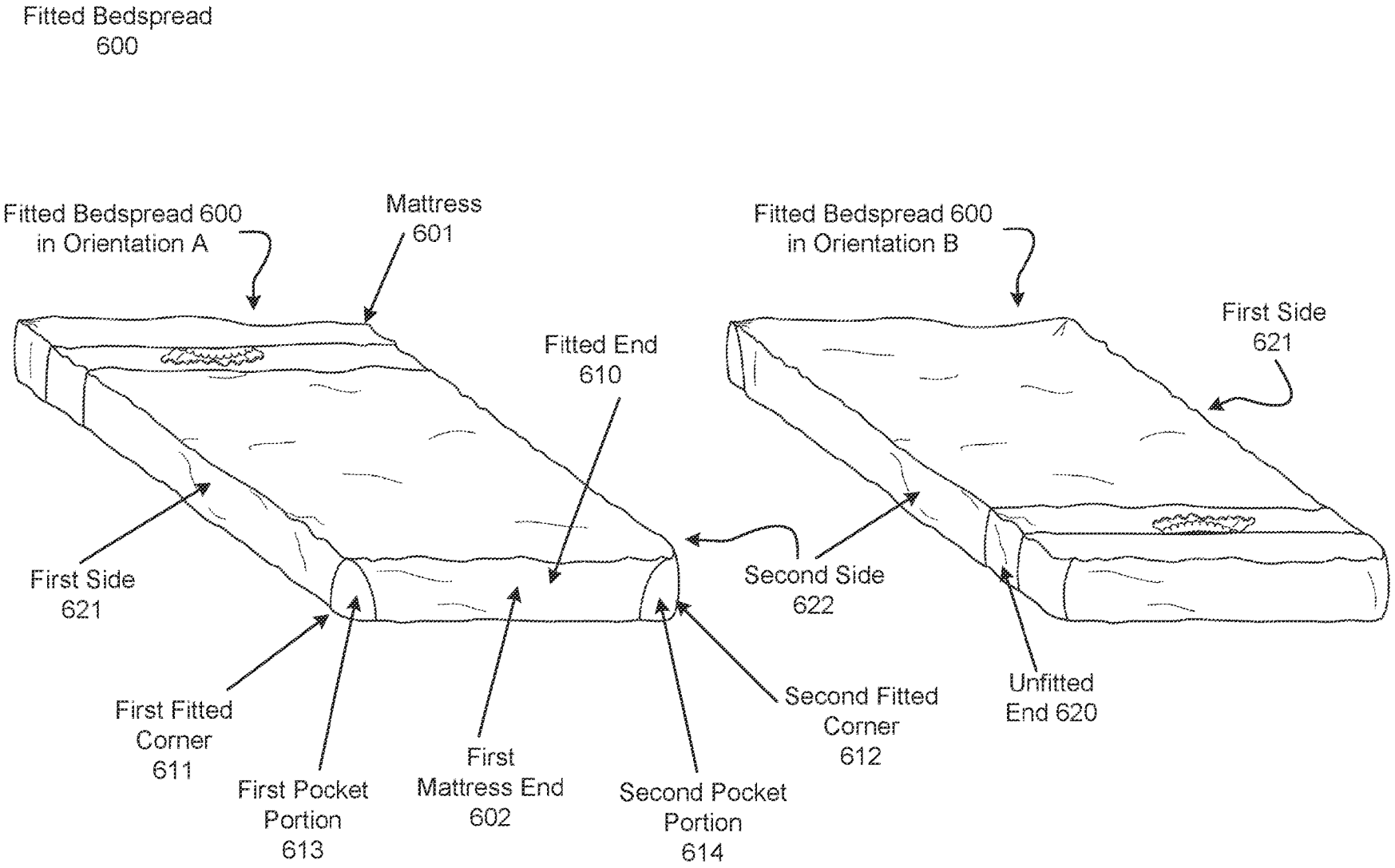
FIGS. 6A and 6B illustrate an example embodiment of a bedspread of the bedding system, in accordance with some embodiments.

FIGS. 6A and 6B illustrate an example embodiment of fitted bedspread 600 of the bedding system, in accordance with some embodiments. FIG. 6A illustrates a fitted end 610 of fitted bedspread 600 in Orientation A. FIG. 6B illustrates an unfitted end 620 of fitted bedspread 600 in Orientation B. In some embodiments, fitted bedspread 600 can be a bedspread such as bedspread 120 as described with respect to FIG. 1. Fitted bedspread 600 includes fitted end 610, first fitted corner 611, and second fitted corner 612. Fitted bedspread 600 can include unfitted end 620 (e.g., closest to the top of the bed) such that the bedspread can be turned down with ease. Fitted end 610 of fitted bedspread 600 can be coupled to the bottom end of mattress 601 (i.e., first mattress end 602 can correspond to the bottom end of mattress 601). Fitted bedspread 600 can include first side 621 and second side 622 which are configured to extend over the respective sides of mattress 601.

In some embodiments, first fitted corner 611 and second fitted corner 612 can be gathered portions of fitted bedspread 600. "Gather" or "gathered" can refer to overlapping portions of one or more sheets of fabric or material with folds or layers to form a 3-dimensional shape, and securing the overlapping portions one to the next to maintain a rudimentary semblance to the 3-dimensional shape. For example, in some embodiments, the gathered portion of fitted bedspread 600 can include overlapping folded portions of fitted bedspread 600 that are formed to a 3-dimensional gentle curve of a mattress corner, and secured such that the overlapping folded portions maintain a rudimentary semblance to the 3-dimensional gentle curve of the mattress corner. In some embodiments, gathered portions of fitted bedspread 600 can include an elastic element (e.g., elastic thread, etc.). In some embodiments, gathered portions of fitted bedspread 600 can include sewn seams. In some embodiments, gathered portions of fitted bedspread 600 can include a plurality of pleats.

In some embodiments, first fitted corner 611 and second fitted corner 612 can include first pocket portion 613 and second pocket portion 614 respectively. First pocket portion 613 and second pocket portion 614 can be separate piece of fabric from the fabric that makes up first fitted corner 611 and second fitted corner 612. In some embodiments, the shape of the first pocket portion 613 and second pocket portion 614 can resemble a "horseshoe" or "half-moon" shape. In some embodiments, first pocket portion 613 and second pocket portion 614 can include two or more pieces of fabric or material. For example, fabric can be cut out at the area of the first pocket portion 613 and second pocket portion 614, and the first pocket portion 613 and the second pocket portion 614 can be sewed into the removed areas. Fitted bedspread 600 can include a first side 621 and a second side 622 which are configured to extend over the respective sides of mattress 601.

First fitted corner 611 couples around a first mattress corner (e.g., a first bottom mattress corner) of mattress 601, and second fitted corner 612 couples around a second mattress corner (e.g., a second bottom mattress corner) of mattress 601. For example, the first fitted corner 611 and second fitted corner 612 can each couple to the respective corners first mattress corner and second mattress corner or mattress 601.

In some embodiments, having one end of the fitted bedspread 600 as a fitted end 610 and the opposite end as the unfitted end 620, can improve the fitting of the fitted bedspread 600 and helps secure the fitted bedspread 600 to the mattress 601, while having the unfitted end 620 can allow the fitted bedspread 600 to be folded down or allow a user to get under the fitted bedspread 600 while the fitted bedspread 600 is still fitted on the mattress 601.

Figure 7:
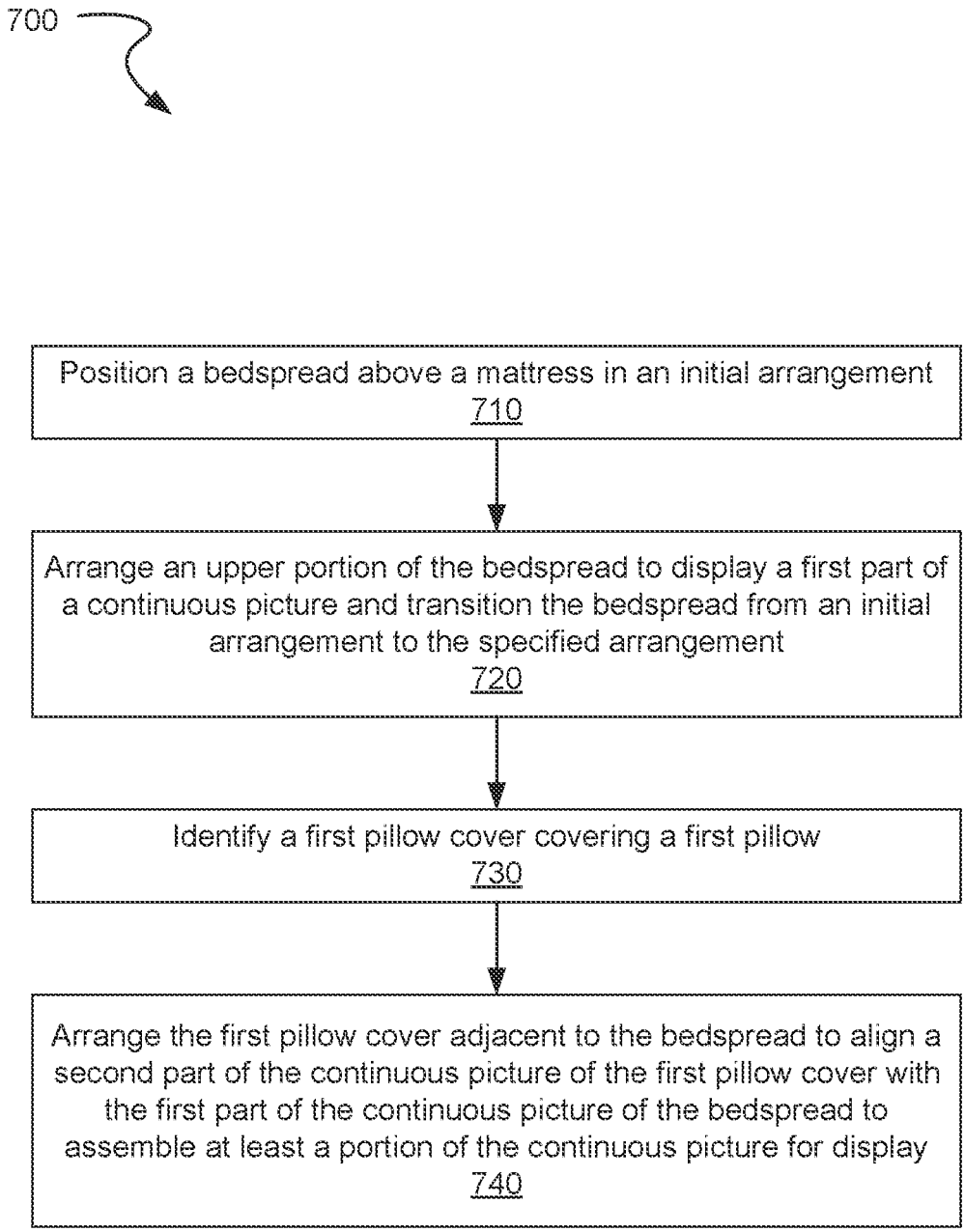
FIG. 7 illustrates a flow diagram of an example method to arrange a bedding system above a mattress using a guide, in accordance with some embodiments.

FIG. 7 illustrates a flow diagram of an example of method 700 to position a bedding system above a mattress in a specified arrangement, in accordance with some embodiments, of the present disclosure. Although shown in a particular sequence or order, unless otherwise specified, the order of the processes can be modified. Thus, the illustrated embodiments should be understood only as examples, and the illustrated processes can be performed in a different order, and some processes can be performed in parallel. Additionally, one or more processes can be omitted in various embodiments. Thus, not all processes are required in every embodiment. Other process flows are possible.

At operation 710, the bedspread is positioned above a mattress in an initial arrangement. In some embodiments, the bedspread includes an upper portion. In some embodiments, the bedspread includes a lower portion. In some embodiments, the bedspread includes a top surface. In some embodiments, the bedspread includes a bottom surface. In some embodiments, the top surface is positioned opposite the bottom surface. In some embodiments, in a first arrangement, at least part of the top surface of the bedspread is configured to face opposite the mattress. In some embodiments, the bedspread includes a first part of a continuous picture. In some embodiments, the first part of the continuous picture is formed on the bottom surface of the bedspread. In some embodiments, the first part of the continuous picture is formed on the upper portion of the bedspread.

At operation 720, the upper portion of the bedspread is arranged to display a first part of a continuous picture and transition the bedspread form an initial arrangement to the specified arrangement. In some embodiments, the initial arrangement can be an "unfolded" arrangement. In some embodiments, the specified arrangement can be a "folded" arrangement.

At operation 730, the first pillow cover covering a first pillow is identified. In some embodiments, the first pillow cover is a pillowcase. In some embodiments, the first pillow cover encases a pillow in a pillowcase. In some embodiments, the first pillow cover includes a first front side. In some embodiments, the first pillow cover includes a first back side. In some embodiments, the bedding system can include two or more pillow covers. In some embodiments, a second part of the continuous picture is formed on the first pillow cover. In some embodiments, the second part of the continuous picture is formed on the first front side of the first pillow cover.

At operation 740, the first pillow cover is arranged adjacent to the bedspread to align the second part of the continuous picture of the first pillow cover with the first part of the continuous picture of the bedspread to assemble at least a portion of the continuous picture for display. In some embodiments, a second pillow cover is arranged adjacent to the bedspread to align a third part of the continuous picture of the second pillow cover with the first part of the continuous picture of the bedspread to assemble at least a portion of the continuous picture for display. In some embodiments, the assembled at least portion of continuous picture can indicate that the method 700 for positioning the bedding system above a mattress in a specified arrangement has been completed.

In the foregoing specification, mattress sizes have been listed as twin, twin extra long (XL), full, queen, king, and California king. The dimensions of each size are as follows: twin, 38 inches wide by 75 inches long; twin XL, 38 inches wide by 80 inches long; full, 54 inches wide by 74 inches long; queen, 60 inches wide by 80 inches long; king, 76 inches wide by 80 inches long; and California king, 72 inches wide by 84 inches long. Other mattress sizes are also considered, and the included mattress sizes here are for an illustrative sense, and are not intended to be restrictive.

In the foregoing specification, embodiments of the disclosure have been described with reference to specific example embodiments thereof. It will be evident that various modifications can be made thereto without departing from the broader spirit and scope of embodiments of the disclosure as set forth in the following claims. The specification and drawings are, accordingly, to be regarded in an illustrative sense rather than a restrictive sense.

What is claimed is:

1. A bedding system configured to position above a mattress in a first arrangement, the bedding system comprising:

a bedspread comprising:

an upper portion of a plurality of portions;

a bottom surface of the plurality of portions;

a top surface of the plurality of portions, the top surface positioned opposite the bottom surface, wherein in the first arrangement at least part of the top surface of the bedspread is configured to face opposite the mattress;

a lower portion of the plurality of portions coupled to the upper portion of the plurality of portions of the bedspread, wherein in the first arrangement the lower portion is configured to position at least in part above the mattress;

a first fabric layer of the top surface of the lower portion of the bedspread, the first fabric layer comprising a first plurality of pleats; and a first part of a continuous picture formed on the bottom surface of the upper portion of the bedspread, wherein in the first arrangement the upper portion is configured in a folded position to display the first part of the continuous picture; and a first pillow cover, configured to encase a first pillow, comprising:

a first front side; and a second part of the continuous picture formed on the first front side of the first pillow cover, wherein in the first arrangement the first pillow cover is configured to be positioned adjacent to the bedspread to align the second part of the continuous picture with the first part of the continuous picture of the bedspread to assemble at least a portion of the continuous picture for display.

2. The bedding system of claim 1, further comprising:

a second pillow cover comprising:

a second front side; and a third part of the continuous picture formed on the second front side of the second pillow cover, wherein in the first arrangement the second pillow cover is configured to be positioned adjacent to the first pillow cover and adjacent to the bedspread to align the third part of the continuous picture with the second part of the continuous picture of the first pillow cover and the first part of the continuous picture of the bedspread to assemble the continuous picture for display.

3. The bedding system of claim 2, wherein:

the first pillow cover comprising a first open end configured to receive the first pillow; and the second pillow cover comprising a second open end configured to receive a second pillow, wherein in the first arrangement the first open end and a second open end face opposite directions.

4. The bedding system of claim 1, wherein the first part of the continuous picture of the upper portion of the bedspread identifies a location along which the upper portion is configured to fold and transition the bedspread from a second arrangement to the first arrangement to display the first part of the continuous picture.

5. The bedding system of claim 1, the bedspread further comprising:

a second fabric layer of the top surface of the lower portion of the bedspread, the second fabric layer comprising a second plurality of pleats, wherein the first fabric layer and the second fabric layer are coupled together to align the first plurality of pleats with the second plurality of pleats.

6. The bedding system of claim 1, the bedspread further comprising:

a third fabric layer of the bottom surface of the lower portion of the bedspread, wherein the third fabric layer is coupled to the first fabric layer using a plurality of stitches that secure the first plurality of pleats to the third fabric layer.

7. The bedding system of claim 1, wherein the first plurality of pleats comprise at least one of horizontal pleats, vertical pleats, or diagonal pleats.

8. The bedding system of claim 1, the bedspread further comprising:

a first side portion of the plurality of portions coupled to the lower portion; and a second side portion of the plurality of portions coupled to the lower portion, wherein in the first arrangement the first side portion and the second side portion are configured to extend over sides of the mattress.

9. The bedding system of claim 8, wherein the first side portion and the second side portion are unpleated.

10. The bedding system of claim 9, wherein in the first arrangement the first side portion and the second side portion are configured to be fitted at a first end of the mattress and unfitted at a second end of the mattress.

11. The bedding system of claim 10, the bedspread further comprising:

a first pocket portion coupled to the first side portion; and a second pocket portion coupled to the second side portion, wherein at least part of the first side portion and the second side portion that are configured to be fitted at the first end of the mattress comprise an elastic element, and wherein in the first arrangement the first pocket portion and the second pocket portion are configured to fit respective corners of the mattress.

12. The bedding system of claim 1, the first pillow cover further comprising:

a first back side coupled to the first front side;

a first open end; and a second open end opposite the first open end, wherein the first open end and the second open end are configured to receive the first pillow.

13. A method for positioning a bedding system above a mattress in a specified arrangement, the method comprising:

positioning a bedspread above the mattress in an initial arrangement, the bedspread comprising:

an upper portion of a plurality of portions;

a bottom surface of the plurality of portions;

a top surface of the plurality of portions, the top surface positioned opposite the bottom surface, wherein in the initial arrangement at least part of the top surface of the bedspread is configured to face opposite the mattress;

a lower portion of the plurality of portions coupled to the upper portion of the plurality of portions of the bedspread, wherein in the initial arrangement the lower portion is configured to position at least in part above the mattress;

a first fabric layer of the top surface of the lower portion of the bedspread, the first fabric layer comprising a first plurality of pleats; and a first part of a continuous picture formed on the bottom surface of the upper portion of the bedspread;

arranging the upper portion to display the first part of the continuous picture and transition the bedspread from the initial arrangement to the specified arrangement;

identifying a first pillow cover covering a first pillow, the first pillow cover comprising:

a first front side; and a second part of the continuous picture formed on the first front side of the first pillow cover; and arranging the first pillow cover adjacent to the bedspread to align the second part of the continuous picture with the first part of the continuous picture of the bedspread to assemble at least a portion of the continuous picture for display.

14. The method of claim 13, further comprising:

identifying a second pillow cover covering a second pillow, the second pillow cover comprising:

a second front side; and a third part of the continuous picture formed on the second front side of the second pillow cover; and arranging the second pillow cover adjacent to the first pillow cover and adjacent to the bedspread to align the third part of the continuous picture with the second part of the continuous picture of the first pillow cover and the first part of the continuous picture of the bedspread to assemble the continuous picture for display.

15. The method of claim 14, wherein the first pillow cover is configured to be arranged at a first side of the mattress in the specified arrangement, and the second pillow cover is configured to be arranged at a second side of the mattress in the specified arrangement, and wherein the first part of the continuous picture is configured to guide the specified arrangement of the first pillow cover based on the second part of the continuous picture and to guide the specified arrangement of the second pillow cover based on the third part of the continuous picture.

16. The method of claim 15, the bedspread further comprising:

a second fabric layer of the bottom surface of the lower portion of the bedspread, wherein the second fabric layer is coupled to the first fabric layer using a plurality of stitches that secure the first plurality of pleats to the second fabric layer.

17. The method of claim 13, the bedspread further comprising:

a first side portion of the plurality of portions coupled to the lower portion; and a second side portion of the plurality of portions coupled to the lower portion, wherein in the specified arrangement the first side portion and the second side portion are configured to extend over respective sides of the mattress.

18. The method of claim 17, wherein the bedspread comprises: a first pocket portion coupled to the first side portion, and a second pocket portion coupled to the second side portion, the method further comprising:

arranging the first pocket portion around a first corner of a first end of the mattress; and arranging the second pocket portion around a second corner of the first end of the mattress, wherein in the specified arrangement the first side portion and the second side portion are configured to be fitted at the first end of the mattress and unfitted at a second end of the mattress.

* * * * *